US009668586B2

(12) United States Patent
Yang

(10) Patent No.: US 9,668,586 B2
(45) Date of Patent: Jun. 6, 2017

(54) CAMP BED FRAME AND CAMP BED

(71) Applicant: ZHEJIANG HENGFENG TOP LEISURE CO., LTD., Zhejiang (CN)

(72) Inventor: Baoqing Yang, Zhejiang (CN)

(73) Assignee: ZHEJIANG HENGFENG TOP LEISURE CO., LTD, Zhejiang (CN)

( * ) Notice: Subject to any disclaimer, the term of this patent is extended or adjusted under 35 U.S.C. 154(b) by 938 days.

(21) Appl. No.: 13/924,133

(22) Filed: Jun. 21, 2013

(65) Prior Publication Data

US 2014/0338122 A1 Nov. 20, 2014

(30) Foreign Application Priority Data

May 17, 2013 (CN) ..... 2013 1 0186527

(51) Int. Cl.
*A47C 17/76* (2006.01)
*A47C 17/64* (2006.01)
*A47C 17/72* (2006.01)

(52) U.S. Cl.
CPC ..... *A47C 17/76* (2013.01); *A47C 17/72* (2013.01); *A47C 17/64* (2013.01)

(58) Field of Classification Search
CPC ..... A47C 17/64; A47C 17/70; A47C 17/72; A47C 17/76; A47C 19/04; A47C 19/12;
(Continued)

(56) References Cited

U.S. PATENT DOCUMENTS 1,080,577 A * 12/1913 Pascale et al. ..... A47C 17/68 5/114
1,305,388 A * 6/1919 Luria ..... A61G 1/00 5/117

(Continued)

FOREIGN PATENT DOCUMENTS

CN 2030831 U 1/1989
CN 2332260 Y 8/1999

(Continued)

OTHER PUBLICATIONS

Chinese 1st Office Action corresponding to Patent No. 201310186527.3; Issue Date : Feb. 22, 2016, with English translation.

(Continued)

*Primary Examiner* — Robert G Santos
(74) *Attorney, Agent, or Firm* — Cantor Colburn LLP

(57) ABSTRACT

A camp bed frame includes two bed bearing tubes and two pillow tubes alternately arranged and forming a rectangular closed frame. At least one of the two bed bearing tubes has a retractable and localizable bed bearing monotube. In use, the two bed bearing tubes are inserted into respective sleeves of a bed cover; one pillow tube is inserted into the corresponding sleeve of the bed cover and mounted at the ends of the bed bearing tubes; the retractable bed bearing monotube is retracted; the other pillow tube is inserted into the corresponding sleeve of the bed cover and mounted at the ends of the bed bearing tubes; and finally, the retractable bed bearing monotube is stretched out until the bed cover is tensioned tightly and positioned. The present application also discloses a camp bed adopting the camp bed frame.

18 Claims, 5 Drawing Sheets

(58) Field of Classification Search
CPC ... A47C 19/122; A47C 19/124; A47C 19/126; A47C 19/14; A47C 19/005; A47C 19/021; A47C 19/025; A61G 1/013; A61G 1/00
USPC .... 5/112, 114–117, 110, 111, 174, 175, 181, 5/182, 184, 200.1, 201, 202, 285, 286.1, 5/625–627
See application file for complete search history.

(56) References Cited

U.S. PATENT DOCUMENTS

| | | | | | |
|---|---|---|---|---|---|
| 1,350,516 | A * | 8/1920 | Pfeifer | A47C 17/76 | 5/112 |
| 1,528,129 | A * | 3/1925 | Phillips | A47C 17/80 | 5/114 |
| 1,678,441 | A * | 7/1928 | McGrew | A47C 17/68 | 5/112 |
| 2,349,023 | A * | 5/1944 | Van Der Hyde | A61G 1/013 | 5/110 |
| 3,799,228 | A * | 3/1974 | Crawford | A45F 4/00 | 220/9.2 |
| 3,933,164 | A * | 1/1976 | Ness et al. | A45F 4/06 | 135/128 |
| 7,856,683 | B2 | 12/2010 | Zheng | | |
| 2008/0189854 | A1 | 8/2008 | Thorne et al. | | |
| 2009/0178195 | A1 | 7/2009 | Zheng | | |
| 2012/0047649 | A1 | 3/2012 | Grace | | |
| 2014/0338122 | A1* | 11/2014 | Yang | A47C 17/76 | 5/112 |

FOREIGN PATENT DOCUMENTS

| | | | |
|---|---|---|---|
| CN | 201157166 | Y | 12/2008 |
| CN | 101342107 | A | 1/2009 |
| CN | 201290479 | Y | 8/2009 |
| CN | 201360778 | Y | 12/2009 |
| CN | 101674759 | A | 3/2010 |
| WO | 0234089 | A1 | 5/2002 |

OTHER PUBLICATIONS

Chinese Second Office Action corresponding to Application No. 201310186527.3; Date of Mailing: Oct. 17, 2016, with English translation.

* cited by examiner

CAMP BED FRAME AND CAMP BED

This application claims the priority from Chinese Patent Application No. 201310186527.3, entitled "CAMP BED FRAME AND CAMP BED" filed on May 17, 2013 with State Intellectual Property Office of PRC, which is incorporated herein by reference in its entirety.

FIELD OF THE INVENTION

The present application relates to the technical field of mechanical industry, and particularly to a camp bed frame and a camp bed.

BACKGROUND OF THE INVENTION

The camp bed is a foldable bed, mainly used in marching army, ordinary user's outdoor leisure and the like. Referring to FIG. 1, an existing camp bed includes a camp bed frame and a bed cover covered on the bed frame. The camp bed frame includes pillow tubes 1, bed bearing tubes and supporting legs 3 fixed on the bed bearing tubes. The bed bearing tube includes a plurality of interconnected bed bearing monotubes 21. The edge of canvas cover is provided with sleeves. The supporting legs 3 are fixed on the bed bearing tubes. In use, the axes of the plurality of bed bearing monotubes 21 coincide with each other, and adjacent bed bearing monotubes 21 are fixedly connected to form the bed bearing tube. The pillow tubes 1 and the bed bearing tubes create a rectangular frame, with long edges being the bed bearing tubes while short edges being the pillow tubes 1. the pillow tubes 1 and the bed bearing tubes all are inserted in corresponding sleeves of the bed cover, and the bed cover is tensioned on the above-mentioned rectangular frame.

When the above camp bed is assembled, two bed bearing tubes are inserted into respective sleeves of the bed cover; a first pillow tube 1 is inserted into the corresponding sleeve of the bed cover and mounted at the ends of the bed bearing tubes; and a second pillow tube 1 is then inserted into the corresponding sleeve of the bed cover and mounted at the ends of the bed bearing tubes. However, in the above camp bed, in order to tension the bed cover, the size of the bed cover is usually determined to be smaller than the size of the above rectangular frame. Thus, when the second pillow tube 1 is assembled, the bed cover is pulled by the first pillow tube 1. As such, it is difficult to mount the second pillow tube to the ends of the bed bearing tubes, which is inconvenient for the user to use.

In conclusion, a problem to be urgently solved by the person skilled in the art is to provide a camp bed which is easy to assemble and convenient for the user to use.

SUMMARY OF THE INVENTION

In view of the foregoing, there is provided a camp bed frame in the present application, in which bed bearing tubes can be retracted when pillow tubes are mounted, and can be stretched out and positioned after the pillow tubes are mounted, so as to ensure the bed cover of the camp bed to be tightly tensioned, thereby allowing the camp bed to be easily assembled with less effort and being convenient for user to use. There is further provided a camp bed in the present application, which adopts the camp bed frame, and thus is assembled easily with less effort and is convenient for the user to use.

In order to achieve the above object, the present application provides the following technical solutions.

A camp bed frame includes two bed bearing tubes and two pillow tubes alternately arranged and forming a rectangular closed frame. At least one of the two bed bearing tubes has a retractable and localizable bed bearing monotube.

Preferably, in the camp bed frame, the retractable bed bearing monotube includes a main body part, a telescopic part and a square bar. The telescopic part is retractable and localizable along the main body part. The square bar is capable of driving the telescopic part to move towards or away from the main body part as it rotates. One end of the main body part is fixed with a connecting member. The telescopic part is provided on a free end of the connecting member. The free end is provided with an accommodating space. A first chain is provided in the accommodating space and has an end hinged to the connecting member. The other end of the first chain is hinged to an end of a second chain, and the second chain is located the accommodating space. The other end of the second chain is provided with a square hole. The telescopic part is provided therein with a first assembling hole corresponding to the accommodating space. A first end of the square bar is inserted through the first assembling hole into the accommodating space, and extends through the square hole; and a second end of the square bar is located outside of the telescopic part.

Preferably, in the camp bed frame, the first end is provided with a nut engaged with threads of a side surface thereof.

Preferably, in the camp bed frame, the telescopic part is provided therein with a second assembling hole corresponding to the nut.

Preferably, in the camp bed frame, a turning handle is fixed on the second end.

Preferably, in the camp bed frame, the retractable bed bearing monotube includes a main body part and a telescopic part. The telescopic part is retractable and localizable along the main body part via a connecting assembly. The connecting assembly includes a threaded shaft, a guide sleeve and a threaded sleeve. The threaded shaft has an end fixed in the main body part and is arranged in an extending direction of the main body part. The guide sleeve is fixed in the telescopic part and is arranged in an extending direction of the telescopic part. The threaded sleeve is arranged at an end of the guide sleeve in such a manner to be rotatable about its axis. The threaded sleeve is in communication with the guide sleeve, and the threaded sleeve is assembled on the threaded shaft. The threaded sleeve is located outside of the telescopic part.

Preferably, in the camp bed frame, the connecting assembly further includes a spring. The guide sleeve has a closed end. One end of the spring is fixedly connected to the closed end of the guide sleeve, and the other end of the spring is fixedly connected to an end of the threaded shaft extending into the guide sleeve.

Preferably, in the camp bed frame, the retractable bed bearing monotube includes a main body part and a telescopic part. The telescopic part is retractable and localizable along the main body part via a levering assembly. The levering assembly includes a lever, a sliding block and a hinge. A middle portion of the lever is hinged in the main body part. The sliding block is fixed in the telescopic part. The hinge has one end hinged to the sliding block and the other end hinged to a first end of the lever near the telescopic part. A second end of the lever is fixed with a spanner. The spanner is located outside of the main body part, and the main body part is provided therein with an arc-shaped groove engaged with the spanner.

Preferably, in the camp bed frame, the retractable bed bearing monotube includes a main body part and a telescopic part. The telescopic part is retractable and localizable along the main body part via a meshing assembly. The meshing assembly includes a rack, a rotary shaft and a gear. The rack is arranged in an extending direction of the telescopic part and is fixed in the telescopic part. The rotary shaft is arranged on the main body part in such a manner to be rotatable about its axis. The gear is fixed on the rotary shaft. The rack extending into the main body part and is engaged with the gear. An end of the rotary shaft extends outside of the main body part and is fixed with a handle.

Preferably, in the camp bed frame, the retractable bed bearing monotube includes a main body part and a telescopic part. The telescopic part is retractable and localizable along the main body part via a pushing assembly. The pushing assembly includes a slipping block and a wheel disc. The slipping block is fixedly connected to the telescopic part. The wheel disc is rotatably arranged in the main body part via a rotary shaft. A first end of the rotary shaft extends outside of the main body part, and a turning spanner is fixed at the first end. A positioning pin is fixed on a disc surface of the wheel disc. The sliding block is provided therein with a groove rotatably engaged with the wheel disc.

A camp bed includes the camp bed frame mentioned in any one of the above technical solutions.

The camp bed frame according to the present application includes two bed bearing tubes and two pillow tubes alternately arranged and forming a rectangular closed frame, wherein at least one of the two bed bearing tubes has a retractable and localizable bed bearing monotube.

In use, the two bed bearing tubes are inserted into respective sleeves of a bed cover; one pillow tube is inserted into the corresponding sleeve of the bed cover and mounted at the ends of the bed bearing tubes; the retractable bed bearing monotube is retracted; the other pillow tube is inserted into the corresponding sleeve of the bed cover and mounted at the ends of the bed bearing tubes; and finally, the retractable bed bearing monotube is stretched out until the bed cover is tensioned tightly and positioned.

In the camp bed frame according to the present application, the bed bearing monotube can be retracted when the pillow tubes are mounted, can be stretched out and positioned after the pillow tubes has been assembled, so as to ensure the bed cover of the camp bed to be tightly tensioned, thereby allowing the camp bed to be easily assembled with less effort and being convenient for user to use.

There is also provided a camp bed in the present application, which adopts the camp bed frame according to the present application, and thus is easy to assembly with less effort and convenient for the user to use.

BRIEF DESCRIPTION OF THE DRAWINGS

In order to more clearly describe embodiments of the present application or the technical solution of the prior art, brief description will be made to the accompanying drawings used for illustrating the embodiments or the prior art below. Obviously, the drawings in the brief description only relate to some embodiments of the present application, and for the person skilled in the art, other drawings may be achieved based on these drawings without creative efforts.

In FIGS. 2 to 12:

| | | |
|---|---|---|
| 101 bed bearing monotube; | 111 main body part; | 112 telescopic part; |
| 113 connecting member; | 114 turning handle; | 115 first chain; |
| 116 pin; | 117 square bar; | 118 second chain; |
| 119 nut; | 200 pillow tube; | 300 hinged leg set; |
| 301 first supporting leg; | 302 second supporting leg; | 501 threaded sleeve; |
| 502 guide sleeve; | 503 spring; | 504 threaded shaft; |
| 701 spanner; | 702 lever; | 703 hinge; |
| 704 sliding block; | 901 handle; | 902 rack; |
| 903 gear; | 1001 turning spanner; | 1002 slipping block; |
| 1003 positioning pin; | 1004 wheel disc. | |

DETAILED DESCRIPTION OF THE INVENTION

An embodiment of the present application discloses a camp bed frame, in which bed bearing tubes can be retracted when pillow tubes are mounted, and can be stretched out after the pillow tubes are mounted, so as to ensure the bed cover of the camp bed to be tightly tensioned, thereby allowing the camp bed to be easily assembled with less effort and being convenient for user to use. There is further provided a camp bed in the present application, which adopts the camp bed frame, and thus is assembled easily with less effort and is convenient for the user to use.

Hereinafter, the technical solutions in the embodiments of the present application will be described clearly and fully in conjunction with the drawings in the embodiments of the present application. Obviously, the described embodiments only are a part of, not all the embodiments of the present application. Other embodiments, which are obtained based on the embodiments of the present application by the person skilled in the art without any creative effort, are all deemed to fall into the scope of protection of the present application.

Figure 1:
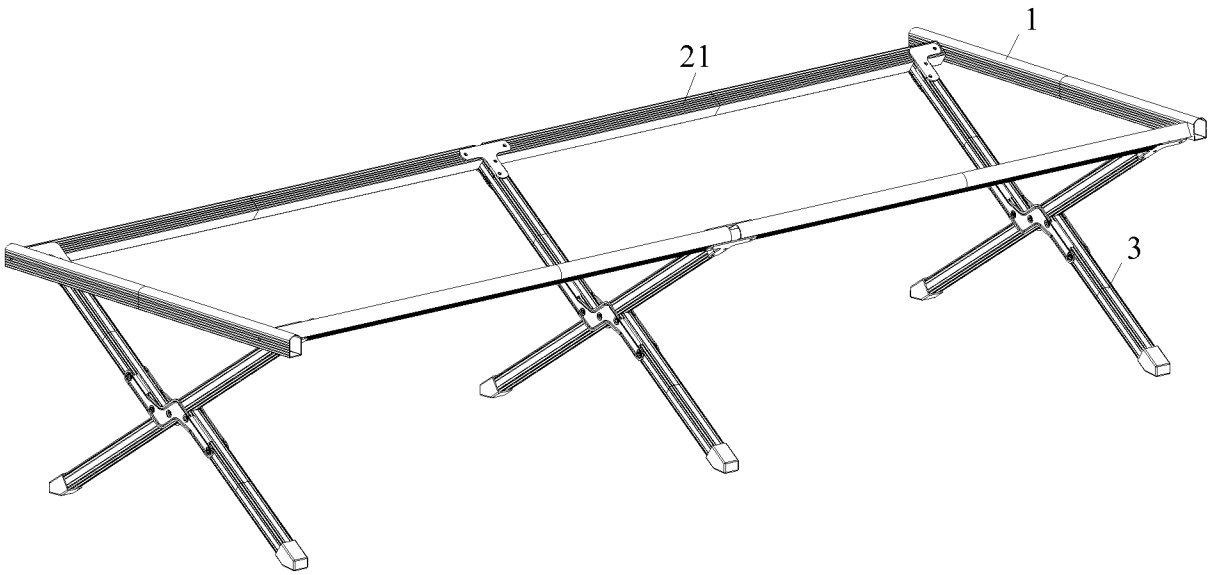
Fig. 1 (Prior Art)
FIG. 1 is a structural schematic view of the camp bed in the prior art.
Figure 2:
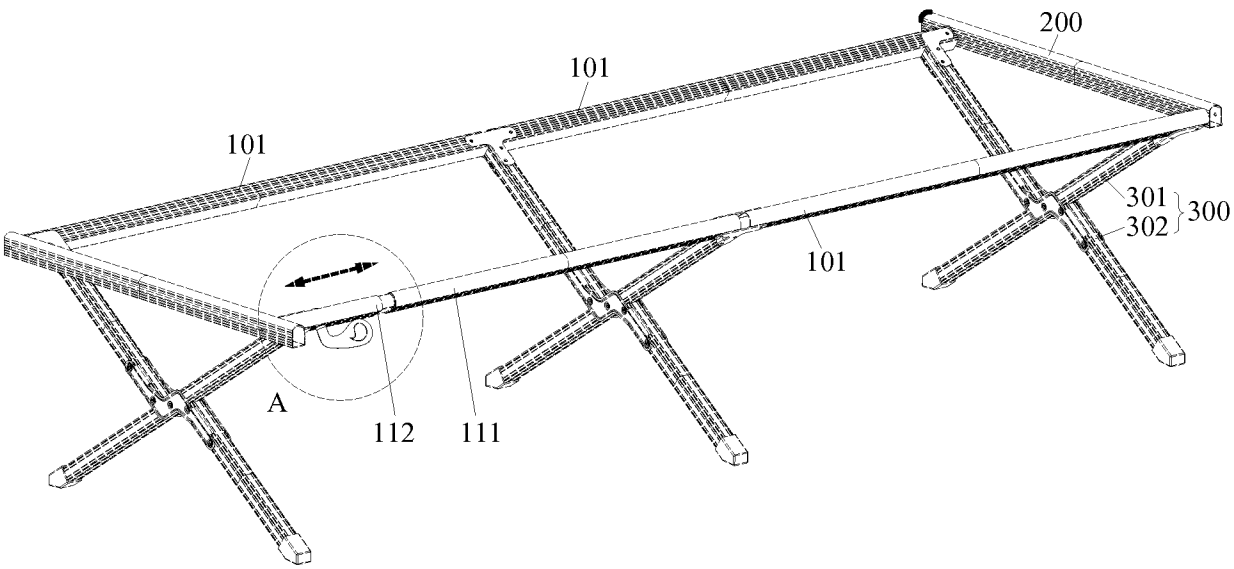
FIG. 2 is a structural schematic view of the camp bed frame according to an embodiment of the present application.
Figure 3:
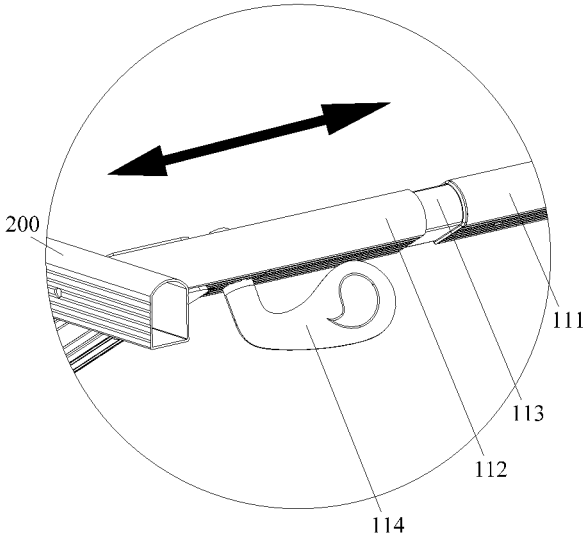
FIG. 3 is a structural schematic view of part A in FIG. 2.
Figure 4:
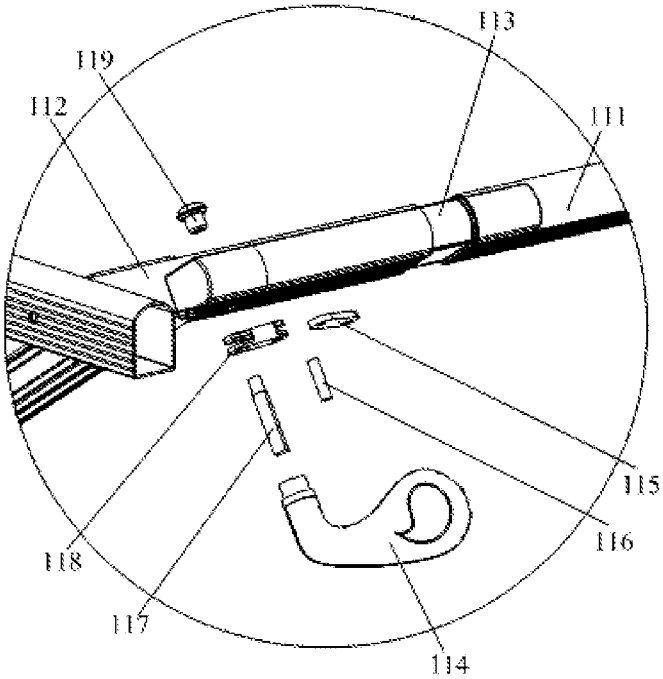
FIG. 4 is an exploded view of FIG. 3.

Referring to FIGS. 2 to 4, the camp bed frame according to the embodiment of the present application includes two bed bearing tubes and two pillow tubes 200, which are alternately arranged and form a rectangular closed frame. At least one of two bed bearing tubes has a bed bearing monotube 101 which is retractable and localizable.

When the camp bed frame is used, the two bed bearing tubes are inserted into respective sleeves of a bed cover; one pillow tube 200 is inserted into the corresponding sleeve of the bed cover and mounted at the ends of the bed bearing tubes; the retractable bed bearing monotube 101 is retracted; the other pillow tube 200 is inserted into the corresponding sleeve of the bed cover and mounted at the ends of the bed bearing tubes; and finally, the retractable bed bearing monotube 101 is stretched out until the bed cover is tensioned tightly and positioned.

The bed bearing tube in the camp bed frame according to the embodiment of the present application can be retracted when the pillow tubes 200 are mounted, can be stretched out and positioned after the pillow tubes 200 has been assembled, so as to ensure the bed cover of the camp bed to be tightly tensioned, thereby allowing the camp bed to be easily assembled with less effort and being convenient for user to use.

Specifically, in the camp bed frame, the bed bearing tube may be composed of one bed bearing monotube 101. Accordingly, each of the two bed bearing tubes may be one retractable bed bearing monotube 101. Alternatively, only one of the two bed bearing tubes may be a retractable bed bearing monotube 101. If the bed bearing tube is configured to include only one bed bearing monotube 101, the bed bearing monotube 101 may be longer, which is inconvenient to carry and store. Thus, the bed bearing tube is preferably configured to be composed of multiple bed bearing monotubes 101, with the axes of the bed bearing monotubes 101 coincide after being assembled, and adjacent bed bearing monotubes 101 being interconnected. Accordingly, the two bed bearing tubes each may be provided with a retractable bed bearing monotube 101. Preferably, only one of the two bed bearing tubes has a retractable bed bearing monotube 101, and only one of the multiple bed bearing monotubes 101 of the bed bearing tube functions to be retractable.

Specifically, in the camp bed frame, the retractable bed bearing monotube 101 includes a main body part 111 and a telescopic part 112 being retractable and localizable along the main body part 111. The telescopic part 112 may be positioned by a positioning hole and an elastic pin engaged with each other. A spring is provided inside the elastic pin, and the end of the spring is fixed to the elastic pin in the form of ball. The elastic pin and the positioning hole are provided on the telescopic part 112 and the main body part 111, respectively. Preferably, the telescopic part 112 may be retracted and positioned along the main body part 111 by a square bar 117, and the square bar 117 can drive the telescopic part 112 to move towards or away from the main body part 111 after being rotated. The specific structure is described as follows.

One end of the main body part 111 is fixed to a connecting member 113. The telescopic part 112 is provided on the free end of the connecting member 113. The free end is provided with an accommodating space in which a first chain 115 is provided. An end of the first chain 115 is hinged to the connecting member 113, and the other end of the first chain 115 is hinged to an end of the second chain 118 through a pin 116. Also, the second chain 118 is located in the accommodating space, and the other end of the second chain 118 is provided with a square hole. The telescopic part 112 is provided therein with a first assembling hole corresponding to the accommodating space. A first end of the square bar 117 is inserted into the accommodating space through the first assembling hole, and passes through the square hole; and a second end of the square bar 117 is located outside the telescopic part 112.

When the camp bed frame is used, assumed that there is an angle of 180° between the first chain 115 and the second chain 118 in an initial state, the second chain 118 is rotated relative to the first chain 115 after the square bar 117 is rotated in a first direction, and drives the first chain 115 to rotate about a hinged shaft between the first chain 115 and the connecting member 113, so that the angle between the first chain 115 and the second chain 118 becomes smaller. The distance between the end of the second chain 118 provided with the square hole and the end of the first chain 115 hinged to the connecting member 113 is reduced, that is, the telescopic part 112 moves towards the main body part 111. In this way, the bed bearing monotube 101 moves in retracted way. Then, the square bar 117 is rotated in a direction opposite to the first direction, so that the first chain 115 and the second chain 118 both returns. The angle between the first chain 115 and the second chain 118 becomes bigger. The distance between the end of the second chain 118 provided with the square hole and the end of the first chain 115 hinged to the connecting member 113 is increased, that is, the telescopic part 112 moves away from the main body part 111. In this way, the bed bearing monotube 101 moves in stretched way. After the camp bed frame is assembled, the angle between the first chain 115 and the second chain 118 is 180°, so that they form a straight bar. Both ends of the straight bar are pushed tightly in opposite directions by the square bar 117 and the connecting member 113 respectively, and are in force balance state to keep stability, thereby positioning the telescopic part 112.

In the camp bed frame, the first assembling hole may be a circular hole to facilitate the rotation of the square bar 117, and sized to just hold the square bar 117 such that the square bar 117 can drive the telescopic part 112 to be stretched out and retracted while rotating.

Preferably, in order to prevent the square bar 117 from falling down, in the camp bed frame according to the above embodiment, the side face of the first end of the square bar 117 is provided with threads, and a nut 119 engaged with the threads is provided at the first end.

Further, in order to facilitate installing the nut 119, in the camp bed frame according to the above embodiment, a second assembling hole corresponding to the nut 119 is provided in the side wall of the telescopic part 112. In assembling, after the square bar 117 is inserted into the square hole, the nut 119 is placed into the accommodating space through the second assembling hole and is assembled at the first end.

Still further, in the camp bed frame, a turning handle 114 is further provided at the second end of the square bar 117.

Figure 5:
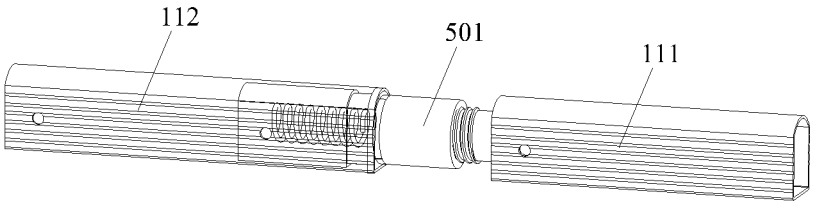
FIG. 5 is a view showing the assembling of a connecting assembly, a main body part and a telescopic part according to an embodiment of the present application.
Figure 6:
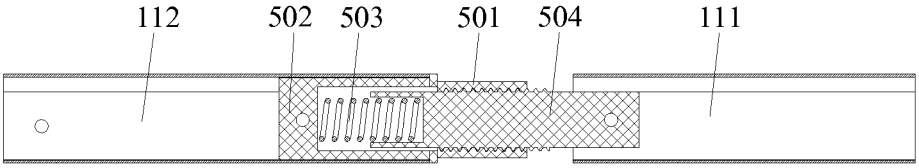
FIG. 6 is an internal structural view of FIG. 5.

Specifically, in the camp bed frame, the telescopic part 112 may also be configured to be retractable and positioned along the main body part 111 via a hinged assembly. As shown in FIGS. 5 and 6, the connecting assembly includes a threaded shaft 504, a guide sleeve 502 and a threaded sleeve 501. The threaded shaft 504 has an end fixed in the main body part 111 and is arranged along the extending direction of the main body part 111. The guide sleeve 502 is fixed in the telescopic part 112 and arranged along the extending direction of the telescopic part 112. The threaded sleeve 501 is arranged at the end of the guide sleeve 502 in such a manner to be rotatable about its axis. The threaded sleeve 501 and the guide sleeve 502 are in communication with each other. The threaded sleeve 501 is installed on the threaded shaft 504, and is located outside of the telescopic part 112. In use, the threaded sleeve 501 is rotated to drive the telescopic part 112 to move towards the main body part 111. After the bed cover and the pillow tubes 200 are assembled, the threaded sleeve 501 is rotated again so as to move the telescopic part 112 away from the main body part 111. After the bed bearing monotube 101 has an appropriate length, the threaded sleeve 501 stops rotating, so that the telescopic part 112 may be locked and the bed cover may be tensioned. Preferably, the connecting assembly further includes a spring 503. The end, far away from the main body part 111, of the guide sleeve 502 is closed. One end of the spring 503 is fixedly connected to the closed end of the guide sleeve 502, and the other end thereof is fixedly connected to the end, stretching in or out of the guide sleeve 502, of the threaded shaft 501. The spring 503 can play a buffer role. The tensioning force on the bed cover is shared by the spring 503 and the engagement between the threaded shaft 504 and the threaded sleeve 501, thereby preventing the threaded connection between the threaded shaft 504 and the threaded sleeve 501 from being damaged.

Figure 7:
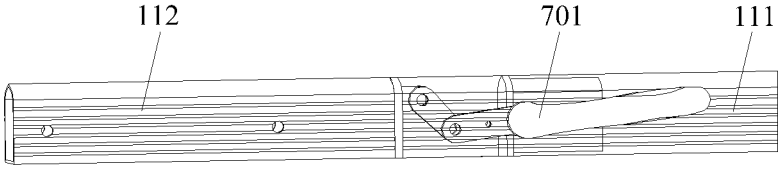
FIG. 7 is a view showing the assembling of a levering assembly, a main body part and a telescopic part according to an embodiment of the present application.
Figure 8:
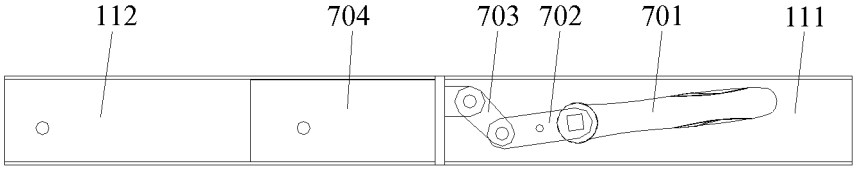
FIG. 8 is an internal structural view of FIG. 7.

In the camp bed frame, the telescopic part 112 may also be configured to be retractable and localizable along the main body part 111 by the levering assembly. As shown in FIGS. 7 and 8, the levering assembly includes a lever 702, a sliding block 704 and a hinge 703. The middle portion of the lever 702 is hinged in the main body part 111. The sliding block 704 is fixed in the telescopic part 112. One end of the hinge 703 is hinged to the sliding block 704, and the other end thereof is hinged to a first end of the lever 702 near the telescopic part 112. A second end of the lever 702 is fixedly connected to the spanner 701. The spanner 701 is located outside of the main body part 111, and the main body part 111 is provided therein with an arc-shaped groove engaged with the spanner 701. In use, the spanner 701 is pulled, such that the spanner 701 slides along the arc-shaped groove. Then, the lever 702 drives the hinge 703 to rotate relative to the lever 702 and the sliding block 704. The sliding block 704 moves towards the main body part 111, that is, the telescopic part 112 moves towards the main body part 111. After the bed cover and the pillow tubes 200 are assembled, the spanner 701 is pulled in an inverse direction, so that the lever 702 drives the hinge 703 to move back. The sliding block 704 moves away from the main body part 111. After the lever 702 and the hinge 703 are in a line and parallel to the extending direction of the telescopic part 112, the sliding block 704 is pushed tightly, and the telescopic part 112 is locked.

Since the sliding block 704 is pushed tightly (that is, the telescopic part 112 is in locked state) when the lever 702 and the hinge 703 are in a line and parallel to the extending direction of the telescopic part 112, the levering assembly in locked state accordingly occupies a larger space inside the telescopic part 112 and the main body part 111. In order to save the space, a cushion block may be further fixed within the main body part 111. When the hinge 703 abuts against the cushion block, the telescopic part 112 may be in locked state, thereby avoiding the hinge 703 and the lever 702 from being in a line.

Figure 9:
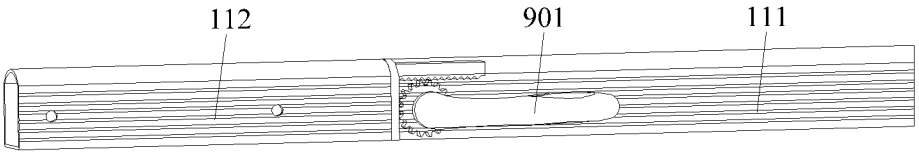
FIG. 9 is a view showing the assembling of a meshing assembly, a main body part and a telescopic part according to an embodiment of the present application.
Figure 10:
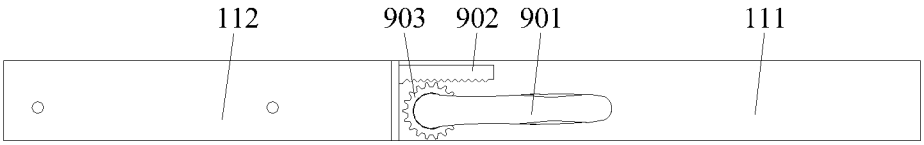
FIG. 10 is an internal structural view of FIG. 9.

In the camp bed frame, the telescopic part 112 may also be configured to be retractable and localizable along the main body part 111 by a meshing assembly. As shown in FIGS. 9 and 10, the meshing assembly includes a rack 902, a rotary shaft and a gear 903. The rack 902 is arranged in the extending direction of the telescopic part 112 and is fixed inside the telescopic part 112. The rotary shaft (not shown) can be provided on the main body part 111 in such a manner to rotate about its axis. The gear 903 is fixed on the rotary shaft. The rack 902 extends in the main body part 111 and is engaged with the gear 903. One end of the rotary shaft extends outside of the main body part 111, and is fixed with a handle 901. In use, the handle 901 is rotated, so that the gear 903 rotates and drives the rack 902 to move towards the main body part 111. Further, the telescopic part 112 move towards the main body part 111. After the bed cover and the pillow tubes 200 are assembled, the handle 901 is rotated inversely, so that the gear 903 rotates inversely and drives the rack 902 to move away from the main body part 111, that is, the telescopic part 112 moves away from the main body part 111. After the telescopic part 112 moves to an appropriate position, the handle 901 stops rotating, and the telescopic part 112 is locked.

Figure 11:
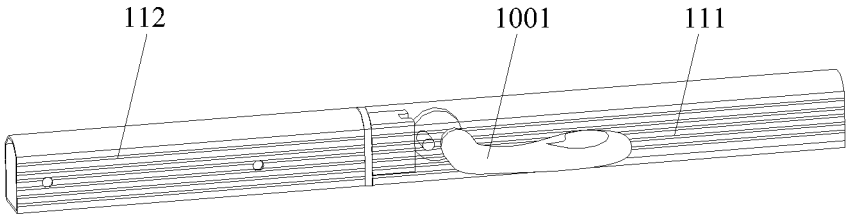
FIG. 11 is a view showing the assembling of a pushing assembly, a main body part and a telescopic part according to an embodiment of the present application.
Figure 12:
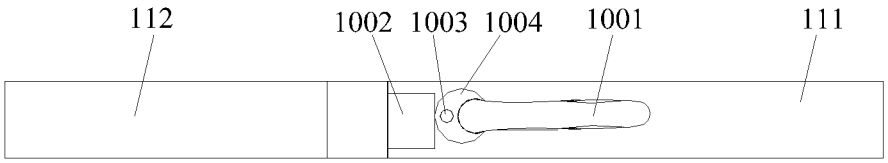
FIG. 12 is an internal structural view of FIG. 10.

In the camp bed frame, the telescopic part 112 may also be configured to be retractable and localizable along the main body part 111 via a pushing assembly. As shown in FIGS. 11 and 12, the pushing assembly includes a slipping block 1002 and a wheel disc 1004. The slipping block 1002 is fixedly connected to the telescopic part 112. The wheel disc 1004 is rotatably arranged in the main body part 111 via a rotary shaft (not shown). A first end of the rotary shaft extends outside of the main body part 111, and a turning spanner 1001 is fixed at the first end. A positioning pin 1003 is fixed on the disc surface of the wheel disc 1004. The slipping block 1002 is provided therein with a groove rotatably engaged with the wheel disc 1004. The edge of the wheel disc 1004 is always engaged in the groove, and the positioning pin 1003 is located outside of the groove. In use, the turning spanner 1001 is rotated, so that the positioning pin 1003 is rotated into the main body part 111, i.e., away from the telescopic part 112. As a result, the slipping block 1002 moves towards the main body part 111, and the wheel disc 1004 moves into the deep of the groove, thereby retracting the telescopic part 112. When the bed cover is tensioned, the turning spanner 1001 is rotated, so that the positioning pin 1003 is rotated away from the main body part 111, i.e., towards the telescopic part 112. The positioning pin 1003 abuts against the telescopic part 112 and enables the telescopic part 112 to be away from the main body part 111. When the direction of the rotary shaft is parallel to the extending direction of the telescopic part 112, the positioning pin 1003 locks the telescopic part 112 tightly. Preferably, the wheel disc 1004 is an eccentric wheel, that is, the rotary shaft is offset from the center of the wheel disc 1004.

Specifically, the supporting leg of the camp bed includes a plurality of hinged leg sets 300. Each hinged leg set 300 includes a first supporting leg 301 and a second supporting leg 302 connected detachably and fixedly to two bed bearing tubes respectively. The first supporting leg 301 and the second supporting leg 302 are hinged with each other at their respective middle portions.

There is further provided a camp bed in an embodiment of the present application, including the camp bed frame according to the above embodiments.

In the camp bed, the bed cover is a canvas cover, and a notch is provided in the bed cover at a position corresponding to the supporting leg.

The embodiments of the specification are described in progressive way. The description of each embodiment is focus on the differences from the other embodiments, the same and similar parts of various embodiments may be referred to each other.

The above description of the embodiments disclosed enables the person skilled in the art to implement or use the present application. Many modifications to these embodiments may be obvious to the person skilled in the art, and the general principle defined therein may be implemented in other embodiments without departing from the spirit or scope of the present application. Therefore, the present application is not limited to these embodiments illustrated herein, and is commensurate with the broadest scope consistent with the principle and novel features disclosed herein.

The invention claimed is:

1. A camp bed frame, comprising two bed bearing tubes and two pillow tubes alternately arranged and forming a rectangular closed frame, wherein at least one of the two bed bearing tubes has a retractable and localizable bed bearing monotube; and wherein the retractable bed bearing monotube comprises a main body part, a telescopic part and a square bar, the telescopic part is retractable and localizable along the main body part, the square bar is capable of driving the telescopic part to move towards or away from the main body part as it rotates; one end of the main body part is fixed with a connecting member; the telescopic part is provided on a free end of the connecting member; the free end is provided with an accommodating space, a first chain is provided in the accommodating space and has an end hinged to the connecting member; the other end of the first chain is hinged to an end of a second chain, and the second chain is located in the accommodating space; the other end of the second chain is provided with a square hole; the telescopic part is provided therein with a first assembling hole corresponding to the accommodating space; a first end of the square bar is inserted through the first assembling hole into the accommodating space, and extends through the square hole; a second end of the square bar is located outside of the telescopic part.

2. The camp bed frame according to claim 1, wherein the first end is provided with a nut engaged with threads of a side surface thereof.

3. The camp bed frame according to claim 2, wherein the telescopic part is provided therein with a second assembling hole corresponding to the nut.

4. The camp bed frame according to claim 1, wherein a turning handle is fixed on the second end.

5. The camp bed frame according to claim 1, wherein the retractable bed bearing monotube comprises a main body part and a telescopic part, the telescopic part is retractable and localizable along the main body part via a connecting assembly; the connecting assembly comprises a threaded shaft, a guide sleeve and a threaded sleeve, the threaded shaft has an end fixed in the main body part and is arranged in an extending direction of the main body part, the guide sleeve is fixed in the telescopic part and is arranged in an extending direction of the telescopic part, the threaded sleeve is arranged at an end of the guide sleeve in such a manner to be rotatable about its axis; the threaded sleeve is in communication with the guide sleeve, and the threaded sleeve is assembled on the threaded shaft; the threaded sleeve is located outside of the telescopic part.

6. The camp bed frame according to claim 5, wherein the connecting assembly further comprises a spring, the guide sleeve has a closed end, one end of the spring is fixedly connected to the closed end of the guide sleeve, the other end of the spring is fixedly connected to an end of the threaded shaft extending into the guide sleeve.

7. The camp bed frame according to claim 1, wherein the retractable bed bearing monotube comprises a main body part and a telescopic part, the telescopic part is retractable and localizable along the main body part via a levering assembly; the levering assembly comprises a lever, a sliding block and a hinge, a middle portion of the lever is hinged in the main body part, the sliding block is fixed in the telescopic part, the hinge has one end hinged to the sliding block and the other end hinged to a first end of the lever near the telescopic part; a second end of the lever is fixed with a spanner; the spanner is located outside of the main body part, and the main body part is provided therein with an arc-shaped groove engaged with the spanner.

8. The camp bed frame according to claim 1, wherein the retractable bed bearing monotube comprises a main body part and a telescopic part, the telescopic part is retractable and localizable along the main body part via a meshing assembly; the meshing assembly comprises a rack, a rotary shaft and a gear, the rack is arranged in an extending direction of the telescopic part and is fixed in the telescopic part, the rotary shaft is arranged on the main body part in such a manner to be rotatable about its axis, the gear is fixed on the rotary shaft; the rack extending into the main body part and is engaged with the gear; an end of the rotary shaft extends outside of the main body part and is fixed with a handle.

9. The camp bed frame according to claim 1, wherein the retractable bed bearing monotube comprises a main body part and a telescopic part, the telescopic part is retractable and localizable along the main body part via a pushing assembly; the pushing assembly comprises a slipping block and a wheel disc, the slipping block is fixedly connected to the telescopic part, the wheel disc is rotatably arranged in the main body part via a rotary shaft; a first end of the rotary shaft extends outside of the main body part, and a turning spanner is fixed at the first end; a positioning pin is fixed on a disc surface of the wheel disc; the sliding block is provided therein with a groove rotatably engaged with the wheel disc.

10. A camp bed, comprising the camp bed frame according to claim 1.

11. The camp bed frame according to claim 10, wherein the first end is provided with a nut engaged with threads of a side surface thereof.

12. The camp bed frame according to claim 11, wherein the telescopic part is provided therein with a second assembling hole corresponding to the nut.

13. The camp bed frame according to claim 10, wherein a turning handle is fixed on the second end.

14. The camp bed frame according to claim 10, wherein the retractable bed bearing monotube comprises a main body part and a telescopic part, the telescopic part is retractable and localizable along the main body part via a connecting assembly; the connecting assembly comprises a threaded shaft, a guide sleeve and a threaded sleeve, the threaded shaft has an end fixed in the main body part and is arranged in an extending direction of the main body part, the guide sleeve is fixed in the telescopic part and is arranged in an extending direction of the telescopic part, the threaded sleeve is arranged at an end of the guide sleeve in such a manner to be rotatable about its axis; the threaded sleeve is in communication with the guide sleeve, and the threaded sleeve is assembled on the threaded shaft; the threaded sleeve is located outside of the telescopic part.

15. The camp bed frame according to claim 14, wherein the connecting assembly further comprises a spring, the guide sleeve has a closed end, one end of the spring is fixedly connected to the closed end of the guide sleeve, the other end of the spring is fixedly connected to an end of the threaded shaft extending into the guide sleeve.

16. The camp bed frame according to claim 10, wherein the retractable bed bearing monotube comprises a main body part and a telescopic part, the telescopic part is retractable and localizable along the main body part via a levering assembly; the levering assembly comprises a lever, a sliding block and a hinge, a middle portion of the lever is hinged in the main body part, the sliding block is fixed in the telescopic part, the hinge has one end hinged to the sliding block and the other end hinged to a first end of the lever near the telescopic part; a second end of the lever is fixed with a spanner; the spanner is located outside of the main body part, and the main body part is provided therein with an arc-shaped groove engaged with the spanner.

17. The camp bed frame according to claim 10, wherein the retractable bed bearing monotube comprises a main body part and a telescopic part, the telescopic part is retractable and localizable along the main body part via a meshing assembly; the meshing assembly comprises a rack, a rotary shaft and a gear, the rack is arranged in an extending direction of the telescopic part and is fixed in the telescopic part, the rotary shaft is arranged on the main body part in such a manner to be rotatable about its axis, the gear is fixed on the rotary shaft; the rack extending into the main body part and is engaged with the gear; an end of the rotary shaft extends outside of the main body part and is fixed with a handle.

18. The camp bed frame according to claim 10, wherein the retractable bed bearing monotube comprises a main body part and a telescopic part, the telescopic part is retractable and localizable along the main body part via a pushing assembly; the pushing assembly comprises a slipping block and a wheel disc, the slipping block is fixedly connected to the telescopic part, the wheel disc is rotatably arranged in the main body part via a rotary shaft; a first end of the rotary shaft extends outside of the main body part, and a turning spanner is fixed at the first end; a positioning pin is fixed on a disc surface of the wheel disc; the sliding block is provided therein with a groove rotatably engaged with the wheel disc.

* * * * *